US009310746B2

(12) United States Patent
Fukuda

(10) Patent No.: US 9,310,746 B2
(45) Date of Patent: Apr. 12, 2016

(54) PRINTING APPARATUS, CONTROL METHOD FOR PRINTING APPARATUS, AND STORAGE MEDIUM

(75) Inventor: Shin Fukuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 610 days.

(21) Appl. No.: 13/444,166

(22) Filed: Apr. 11, 2012

(65) Prior Publication Data

US 2012/0263511 A1 Oct. 18, 2012

(30) Foreign Application Priority Data

Apr. 15, 2011 (JP) ..... 2011-091165

(51) Int. Cl.
*G03G 15/00* (2006.01)

(52) U.S. Cl.
CPC ..... *G03G 15/6508* (2013.01)

(58) Field of Classification Search
CPC ..... G03G 15/6508
USPC ..... 399/391
See application file for complete search history.

(56) References Cited

U.S. PATENT DOCUMENTS 5,199,694 A * 4/1993 Iseda ..... 271/9.05
2004/0042038 A1* 3/2004 Uejo ..... 358/1.15
2005/0105146 A1* 5/2005 Tanaka ..... 358/498
2005/0213996 A1* 9/2005 Amano ..... G03G 15/6508 399/16
2006/0061817 A1* 3/2006 Kakigi ..... G06F 3/1205 358/1.15
2006/0285900 A1* 12/2006 Kurita ..... 399/361
2007/0201071 A1* 8/2007 Yamada ..... G06F 3/1205 358/1.13
2008/0003011 A1* 1/2008 Unno ..... G03G 15/6508 399/82
2009/0261524 A1* 10/2009 Nakayama et al. ..... 271/3.14
2010/0178067 A1* 7/2010 Azami ..... G03G 15/6508 399/16
2010/0214618 A1* 8/2010 Maehira ..... 358/3.12
2010/0328709 A1* 12/2010 Hirako et al. ..... 358/1.15
2011/0261378 A1* 10/2011 Taima ..... 358/1.12

FOREIGN PATENT DOCUMENTS

JP 2005-008360 A 1/2005
JP 2009-256074 A 11/2009
JP 2010-2967 A 1/2010

* cited by examiner

*Primary Examiner* — Anthony Nguyen
(74) *Attorney, Agent, or Firm* — Canon USA Inc. IP Division

(57) ABSTRACT

A printing apparatus having a plurality of sheet storage units that stores sheets to be supplied to a printing unit includes a reception unit configured to receive, from an external printing apparatus in which a sheet storage unit group constituted by arbitrary sheet storage units of a plurality of sheet storage units has been formed, paper information that is information of sheets stored in respective sheet storage units that constitute the sheet storage unit group, and a creation unit configured to form a sheet storage unit group corresponding to a sheet storage unit group formed in the external printing apparatus using arbitrary sheet storage units of the plurality of sheet storage units which the printing apparatus has, based on the information of the sheets stored in each of the plurality of sheet storage units which the external printing apparatus has, and the paper information received by the reception unit.

13 Claims, 14 Drawing Sheets

FIG.4

| 401 SHEET STORAGE UNIT | 402 SHEET SIZE | 403 SHEET TYPE | 404 SHEET STORAGE UNIT GROUP |
|---|---|---|---|
| 1 | A4 | PLAIN PAPER | 1 |
| 2 | A4 | PLAIN PAPER | 1 |
| 3 | A4 | PLAIN PAPER | 1 |
| 4 | A3 | THICK PAPER | 2 |
| 5 | A3 | THICK PAPER | 2 |
| 6 | LTR | PLAIN PAPER | 3 |
| 7 | LTR | COATED PAPER | 3 |
| 8 | LTR | COATED PAPER | 3 |

FIG.9A

| 901 SHEET STORAGE UNIT | 902 SHEET SIZE | 903 SHEET TYPE | 904 SHEET STORAGE UNIT GROUP AFTER COPYING |
|---|---|---|---|
| 1 | A4 | PLAIN PAPER | 1 |
| 2 | A4 | PLAIN PAPER | 1 |
| 3 | A4 | PLAIN PAPER | 1 |
| 4 | A3 | THICK PAPER | 2 |
| 5 | A3 | THICK PAPER | 2 |
| 6 | LTR | PLAIN PAPER | 3 |
| 7 | LTR | COATED PAPER | 3 |
| 8 | LTR | COATED PAPER | 3 |

FIG.9B

| 911 SHEET STORAGE UNIT | 912 SHEET SIZE | 913 SHEET TYPE | 914 SHEET STORAGE UNIT GROUP AFTER COPYING |
|---|---|---|---|
| 1 | A4 | PLAIN PAPER | MANUAL SETTING BY SHEET STORAGE UNIT GROUP SETTING UNIT 201 |
| 2 | A4 | PLAIN PAPER | |
| 3 | A4 | PLAIN PAPER | |
| 4 | A4 | THICK PAPER | |
| 5 | A3 | THICK PAPER | |
| 6 | A3 | PLAIN PAPER | |
| 7 | LTR | COATED PAPER | |
| 8 | A3 | THICK PAPER | |

FIG.9C

| 921 SHEET STORAGE UNIT | 922 SHEET SIZE | 923 SHEET TYPE | 924 SHEET STORAGE UNIT GROUP AFTER COPYING |
|---|---|---|---|
| 1 | A4 | PLAIN PAPER | 1 |
| 2 | A4 | PLAIN PAPER | 1 |
| 3 | LTR | COATED PAPER | 3 |
| 4 | A3 | THICK PAPER | 2 |
| 5 | A4 | PLAIN PAPER | 1 |
| 6 | LTR | PLAIN PAPER | 3 |
| 7 | A3 | THICK PAPER | 2 |
| 8 | LTR | COATED PAPER | 3 |

| SHEET STORAGE UNIT | SHEET SIZE | SHEET TYPE | SHEET STORAGE UNIT GROUP |
|---|---|---|---|
| 1 | A4 | PLAIN PAPER | 1 |
| 2 | A4 | PLAIN PAPER | 1 |
| 3 | A4 | PLAIN PAPER | 1 |
| 4 | A3 | THICK PAPER | 2 |
| 5 | A3 | THICK PAPER | 2 |
| 6 | LTR | PLAIN PAPER | 3 |
| 7 | LTR | COATED PAPER | 3 |
| 8 | LTR | COATED PAPER | 3 |

| SHEET STORAGE UNIT | SHEET SIZE | SHEET TYPE | SHEET STORAGE UNIT GROUP |
|---|---|---|---|
| 1 | A4 | PLAIN PAPER | 1 |
| 2 | A4 | PLAIN PAPER | 1 |
| 3 | A4 | PLAIN PAPER | 1 |
| 4 | A4 | THICK PAPER | 2 |
| 5 | A3 | THICK PAPER | 2 |
| 6 | A3 | PLAIN PAPER | 3 |
| 7 | LTR | COATED PAPER | 3 |
| 8 | A3 | THICK PAPER | 3 |

PRINTING APPARATUS, CONTROL METHOD FOR PRINTING APPARATUS, AND STORAGE MEDIUM

BACKGROUND OF THE INVENTION

1. Field of the Invention

The present invention relates to a printing apparatus having a plurality of sheet storage units that stores sheets to be supplied to a printing unit, and also to a control method therefor, and a storage medium.

2. Description of the Related Art

In a conventional printing apparatus, there is a method for providing a plurality of sheet storage units that stores sheets to be supplied to a printing unit, and creating and utilizing a sheet storage unit group constituted by arbitrary sheet storage units out of these sheet storage units as discussed in Japanese Patent Application Laid-Open No. 2005-008360.

By creating the sheet storage unit group, for example, sheets to be used for printing can be restricted to the sheets set in the sheet storage units within the group. As a result, careless use of unintended sheets is prevented, accordingly management of the sheets has become easy.

Also, in a print job executed by designating sheet storage units to be used for print processing, by permitting only automatic switching between the sheet storage units limited within the group, the user can perform printing in which unintended use of the sheets is restrained, while making use of the plurality of sheet storage units. Accordingly, even when the sheets have run out in one sheet storage unit, sheet feeding from another sheet storage unit has become possible, without stopping an operation of the printer engine.

However, this sheet storage unit group has a problem that the user needs to have manually performed settings in advance for grouping which sheet storage units among a plurality of sheet storage units to the same group, which involves great time and effort, for example, in a case where a plurality of printing apparatuses exists.

To solve such a problem, a printing apparatus capable of automatically performing creation of the sheet storage unit groups is also discussed in Japanese Patent Application Laid-Open No. 2009-256074. In Japanese Patent Application Laid-Open No. 2009-256074, the sheet storage unit groups are formed by acquiring attributes of the sheets stored in the sheet storage units, and automatically grouping the sheet storage units for which identical paper sizes and paper types have been set.

In this way, in the conventional technique, the sheet storage unit groups are formed in each printing apparatus.

On the other hand, there exists a technique for copying settings performed on one printing apparatus into another printing apparatus, among a plurality of printing apparatuses. By copying into the other printing apparatus the settings of the sheet storage unit groups already formed in the printing apparatus, using this technique, time and effort involved for formation of the sheet storage unit groups with respect to the plurality of printing apparatuses can be reduced.

However, in a case where the settings of the sheet storage unit groups are copied into another printing apparatus, the following problem arises. That is, even if the settings have been directly copied into another printing apparatus, settings of the sheet storage unit groups of the copy source and settings of the sheet storage unit groups of the copy destination may not have the same configurations, depending on the situation of the sheets actually stored in the sheet storage units.

For example, assuming that first and second sheet storage units are grouped in a first printing apparatus to form a sheet storage unit group, consider that A4 size sheets are stored in both the sheet storage units.

By copying the settings of the sheet storage unit group into a second printing apparatus, first and second sheet storage units can also be grouped in the second printing apparatus to form a sheet storage unit group. At this time, similar to the first printing apparatus, in a case where A4 size sheets are contained in both the first and second sheet storage units, also in the second printing apparatus, there is no problem since the sheet storage unit groups formed in the first and second printing apparatuses each have the same configurations.

However, in a case where sheets in a size other than A4 size are contained in at least anyone of the first and second sheet storage units in the second printing apparatus, sheet storage unit groups having different configurations between the first printing apparatus and the second printing apparatus will be formed. In this case, there is a possibility that the second printing apparatus will perform sheet feeding operation against the user's intention.

SUMMARY OF THE INVENTION

The present invention is directed to a printing apparatus, a control method for a printing apparatus, and a storage medium capable of preventing sheet storage unit groups from being formed against the user's intention, between printing apparatuses in which the situations of the sheets stored in the sheet storage units are different from each other.

According to an aspect of the present invention, there is provided a printing apparatus having a plurality of sheet storage units that stores sheets to be supplied to a printing unit. The printing apparatus includes a reception unit configured to receive, from an external printing apparatus in which a sheet storage unit group constituted by arbitrary sheet storage units of a plurality of sheet storage units has been formed, paper information that is information of sheets stored in respective sheet storage units that constitute the sheet storage unit group. The printing apparatus also includes a creation unit configured to form a sheet storage unit group corresponding to a sheet storage unit group formed in the external printing apparatus using arbitrary sheet storage units of the plurality of sheet storage units which the printing apparatus has, based on the information of the sheets stored in each of the plurality of sheet storage units which the external printing apparatus has, and the paper information received by the reception unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 is a schematic diagram illustrating sheet storage unit group settings according to an exemplary embodiment of the present invention.

FIGS. 9A, 9B, and 9C are diagrams illustrating sheet storage unit configurations for describing an operation of the printing apparatus according to the first exemplary embodiment of the present invention.

DESCRIPTION OF THE EMBODIMENTS

Various exemplary embodiments, features, and aspects of the invention will be described in detail below with reference to the drawings.

Figure 1:
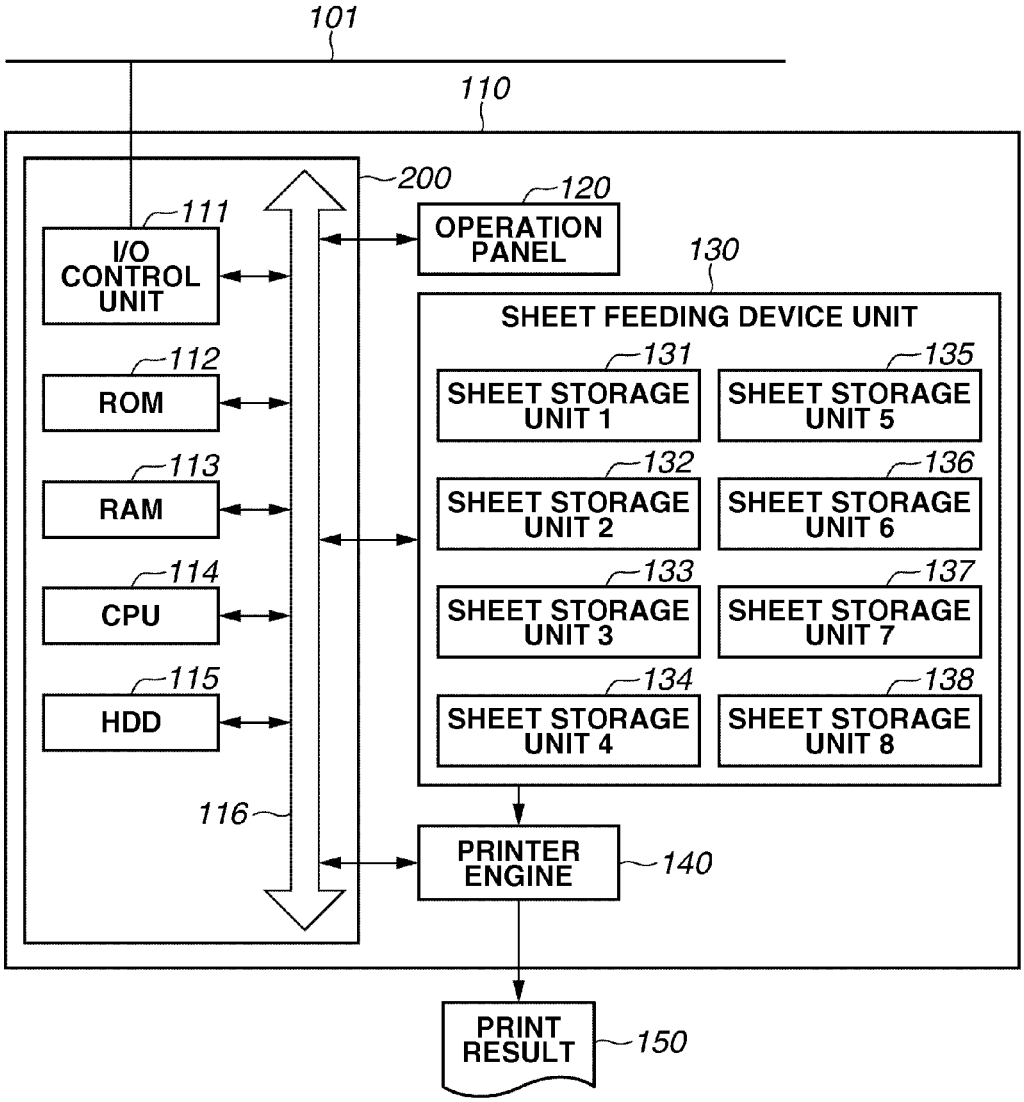
FIG. 1 is a block diagram illustrating a hardware configuration of a printing apparatus according to an exemplary embodiment of the present invention.

FIG. 1 is a block diagram illustrating a hardware configuration as an exemplary embodiment of a printing apparatus according to the present invention.

As illustrated in FIG. 1, a printing apparatus 110 according to the present exemplary embodiment is capable of performing communications with external devices connected to a communication line 101. The printing apparatus 110 is provided with printing functions, and includes all types of apparatuses with printing functions such as a copying machine, a multifunction peripheral, and a facsimile apparatus.

Further, the communication line 101 may be a network such as a local area network (LAN), a wide area network (WAN), or may be a predetermined interface such as a universal serial bus (USB). In addition, the communication line 101 may be any one of wired and wireless.

A controller 200 performs various types of data processing, and controls operation of the printing apparatus. An operation panel 120 is of a touch panel type and accepts various types of operations from users and displays various types of information. Naturally, the operation panel 120 may be constituted by a display unit other than the touch panel type or hard keys.

A sheet feeding device unit 130 is a sheet feeding device including a plurality of sheet storage units (e.g., sheet storage units 1 to 8). A printer engine 140 as a printing unit physically prints image data on print sheets. A print result 150 (sheets) is a result printed by the printer engine.

Next, a configuration of the controller 200 will be described. An input/output (I/O) control unit 111 performs communication control with the communication line 101. A read only memory (ROM) 112 stores various types of control programs (e.g., programs for executing flowcharts described below). A random access memory (RAM) 113 reads out and records the control programs stored in the ROM 112.

A central processing unit (CPU) 114 executes the control programs read out in the RAM 113, and collectively controls image signals or various types of devices. A hard disk drive (HDD) 115 is used for the purpose of retaining a large capacity of data such as image data or print data on a temporary or long-term basis.

These respective modules are connected to one another via a system bus 116. Furthermore, the system bus 116 connects the controller 200 and respective devices arranged in the printing apparatus 110.

The RAM 113 also functions as a main memory and a work memory of the CPU 114. The control programs and operating systems are stored in the HDD 115 in addition to the ROM 112. Furthermore, a nonvolatile RAM (NVRAM) (not illustrated) may be provided, and may be store printing apparatus mode setting information input from the operation panel 120.

A sheet feeding device unit 130 includes a plurality of sheet storage units. The sheet feeding device unit 130 may be sheet storage units originally equipped in a printing apparatus main body, or may be sheet storage units such as optional externally-installed sheet storage units or manual feed type sheet storage units. Alternatively, the sheet feeding device unit 130 may include both of them.

In the present exemplary embodiment, it is assumed that there exist eight sheet storage units in total from a sheet storage unit 131 to a sheet storage unit 138 (hereinafter, each referred to as a sheet storage unit 1 to 8).

In the respective sheet storage units, it is possible to store print sheets. In the respective sheet storage units, it is possible to separate only one uppermost sheet of the stored sheets and convey it to the printer engine 140.

Figure 2:
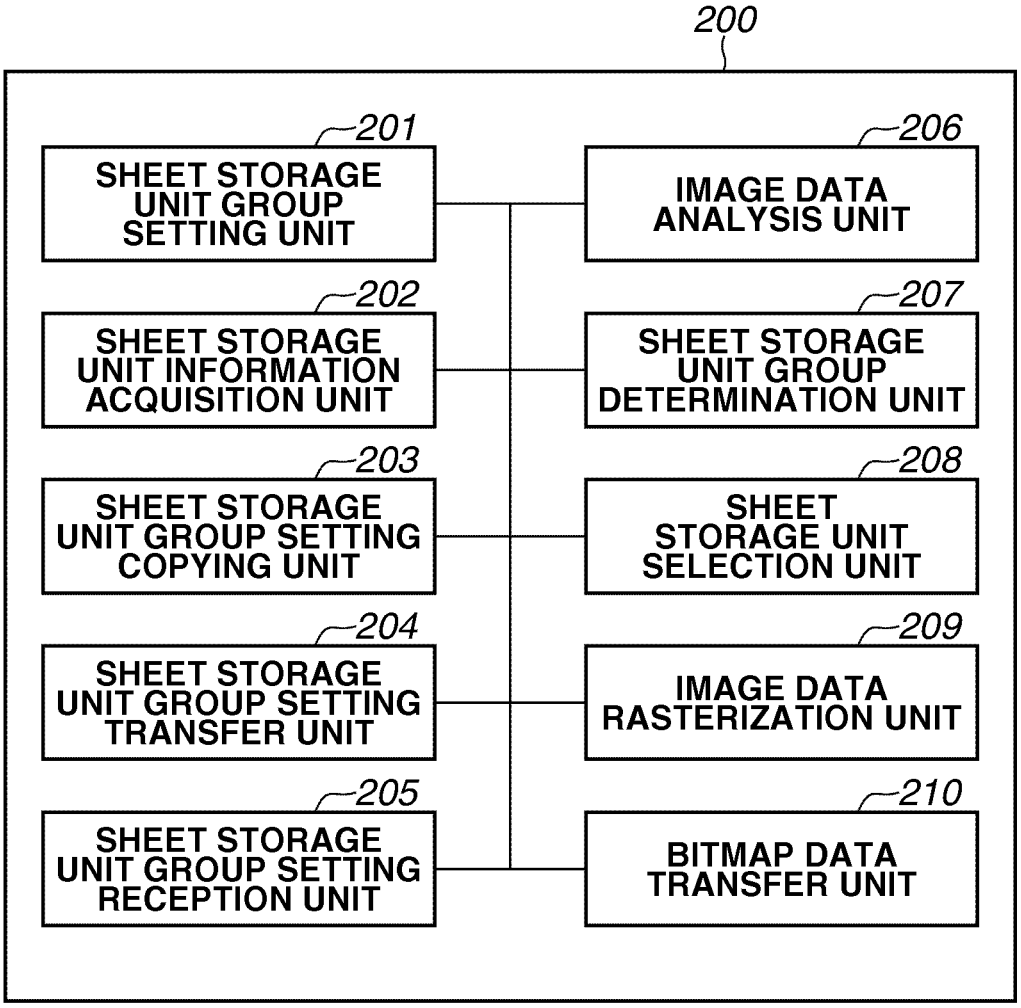
FIG. 2 is a block diagram illustrating a software module configuration of the printing apparatus according to an exemplary embodiment of the present invention.

FIG. 2 is a block diagram illustrating a software module configuration of the printing apparatus 110. These software modules are arranged in the controller board 200, stored in the ROM 112 or the HDD 115, read out in the RAM 113 as needed, and executed by the CPU 114.

A sheet storage unit group setting unit 201 is a control program for displaying a menu on the operation panel 120 or the like, and accepting settings relating to sheet storage unit groups which the user desires. A sheet storage unit information acquisition unit 202 acquires paper information such as paper sizes, and paper types set for the respective sheet storage units of the printing apparatus.

A sheet storage unit grouping setting copying unit 203 copies the settings relating to sheet storage unit groups set for an external printing apparatus, in the printing apparatus itself.

A sheet storage unit group setting transfer unit 204 receives a request from an external printing apparatus, and transfers sheet storage unit group setting information of the printing apparatus itself to the external printing apparatus. A sheet storage unit group setting reception unit 205 receives the sheet storage unit information transferred from the external printing apparatus.

An image data analysis unit 206 analyzes the received print job, and controls various types of devices based on print settings included in the print job.

The print settings refer mainly to information concerning sheet feeding such as paper sizes, paper types, sheet storage units used in printing, information concerning one-sided/two-sided printing, and information concerning finishing process such as stapling, bookbinding settings, and the like.

A sheet storage unit group determination unit 207 determines sheet storage unit groups used for printing, based on the print settings analyzed by the image data analysis unit 206. In a case where a designation command of sheet storage unit groups to be used is included in advance in the print job, the sheet storage unit groups are selected.

In a case where the designation command of the sheet storage unit groups is not included in the print job, the sheet storage unit group determination unit 207 determines sheet storage unit groups used for the printing based on the information concerning sheet feeding analyzed by the image data analysis unit 206.

The sheet storage unit selection unit 208 selects sheet storage units to be used for the printing from the sheet storage units included in the sheet storage unit groups determined by the sheet storage unit group determination unit 207, with respect to respective print pages included in the print job.

An image data rasterization unit 209 rasterizes print image data included in the print job into bitmap data which can be printed by the printer engine 140. Although normally the print image data is described with page description language (PDL), the print image data may have been rasterized in advance into the bitmap data by a host computer or the like, depending on the print job.

In this case, the image data rasterization unit 209 performs only color conversion processing for converting the image data into color space for the printer engine 140.

The bitmap data generated by the image data rasterization unit 209 is once stored in a storage device such as the HDD 115.

A bitmap data transfer unit 210 transfers the bitmap data generated by the image data rasterization unit 209 to the printer engine 140, in synchronization with the timing when the print sheet is conveyed from the sheet feeding device unit 130 to the printer engine 140.

Figure 3:
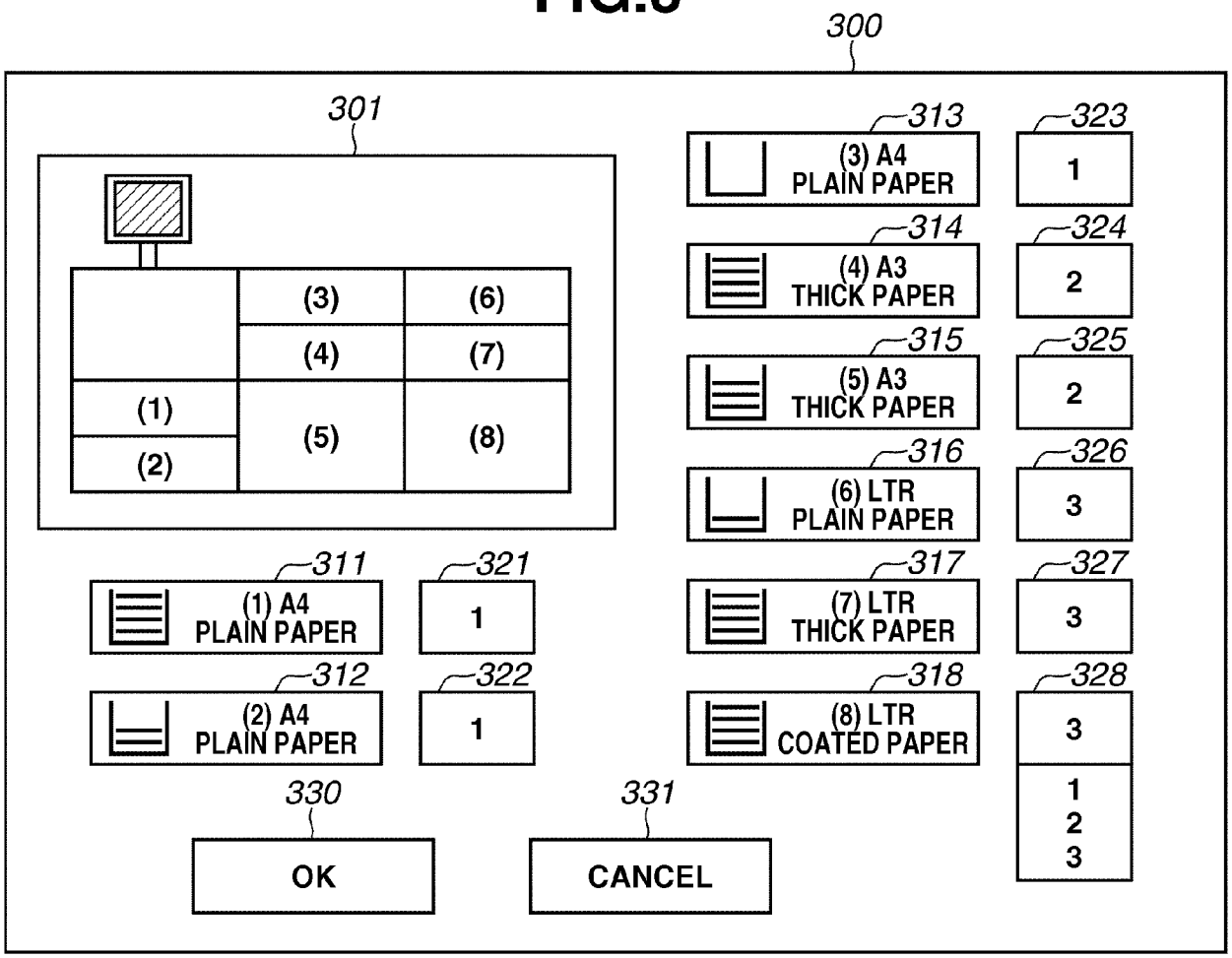
FIG. 3 is an example of a menu screen on which settings of sheet storage unit groups according to an exemplary embodiment of the present invention are performed.

FIG. 3 illustrates an example of a menu screen on which a user performs settings regarding the sheet storage unit groups, in the printing system in the present exemplary embodiment.

A full menu screen 300 is displayed on the operation panel 120. The menu screen 300 is formed by the sheet storage unit group setting unit 201. Image graphics 301 represents the printing apparatus 110.

The user can confirm physical arrangements of the respective sheet storage units, by referring to the image graphics 301. In the image graphics 301, the sheet storage units 1 to 8 are displayed corresponding to numbers of (1) to (8) assigned to each unit.

A display field 311 indicates information such as a paper size, a paper type, and a remaining amount of stored sheets set in the sheet storage unit 1 (displayed as (1) in the menu screen). The remaining amount of the stored sheets is notified to the user, by displaying an icon determined according to the remaining amount. Also in the sheet storage unit 2 to the sheet storage unit 8, information is similarly displayed in display fields 312 to 318.

A sheet storage unit group number display field 321 displays therein a sheet storage unit group number assigned to the sheet storage unit 1 (displayed as (1) in the menu screen).

On the menu screen 300, it is shown that the sheet storage unit 1 is set so as to belong to the sheet storage unit group "1". Also in the sheet storage unit 2 to the sheet storage unit 8, the sheet storage unit group numbers are similarly displayed in sheet storage unit group number display fields 322 to 328.

The sheet storage unit group number display field 321, when selected by the user on the operation unit 120, displays an option in a drop-down list type so that the user can change the setting of the sheet storage unit group currently set.

The sheet storage unit group number display field 328 indicates a state in which the sheet storage unit group number display field 321 for the sheet storage unit 8 is selected, and the drop-down list is expanded. As illustrated in the sheet storage unit group number display field 328, the current sheet storage unit group can be changed to any one of the sheet storage unit groups "1", "2", and "3" in the drop-down list.

In this case, "1", "2", and "3" represent sheet storage unit group numbers, and the sheet storage units assigned the same sheet storage unit group number are set as belonging to the same sheet storage unit group. The number of settable groups is not limited to three.

An OK button 330, when pressed, determines the current settings of the menu screen 300, and closes the menu screen 300.

A cancel button 331, when pressed, cancels setting change which has been set on the menu screen 300 and closes the screen. In a case of having been cancelled, the previous settings are subsequently employed for the settings relating to the sheet storage unit groups. In this manner, the settings relating to the sheet storage unit group can be set and changed.

The settings determined by the sheet storage unit group setting unit 201 are stored as appropriate in a storage device such as the RAM 113 or the HDD 115 or the NVRAM, so that the CPU 114 can refer to the settings as needed.

FIG. 4 is a table illustrating an example of sheet storage unit group settings stored in a storage device. A column 401 is identification information for identifying sheet storage units, and illustrates sheet storage unit numbers. Columns 402 and 403 respectively illustrate paper sizes and paper types set for the sheet storage units.

These pieces of information are called paper information, but information other than the paper sizes and paper types may be included in the paper information. A column 404 represents sheet storage unit group numbers set for the respective sheet storage units.

In FIG. 4, it is illustrated that the sheet storage unit 1, the sheet storage unit 2, and the sheet storage unit 3 are set in the sheet storage unit group 1. The sheet storage unit 4 and the sheet storage unit 5 are set in the sheet storage unit group 2. The sheet storage unit 6, the sheet storage unit 7, and the sheet storage unit 8 are set in the sheet storage unit group 3.

In the present exemplary embodiment, all sheet storage unit groups each are constituted by a plurality of sheet storage units, but only one sheet storage unit may constitute one sheet storage unit group. In other words, one sheet storage unit group is constituted of at least one sheet storage unit.

In the present exemplary embodiment, an example will be described in which sheet storage unit group settings set in the one printing apparatus are copied in another printing apparatus when two sets of printing apparatuses are connected to a communication line.

Figure 5:
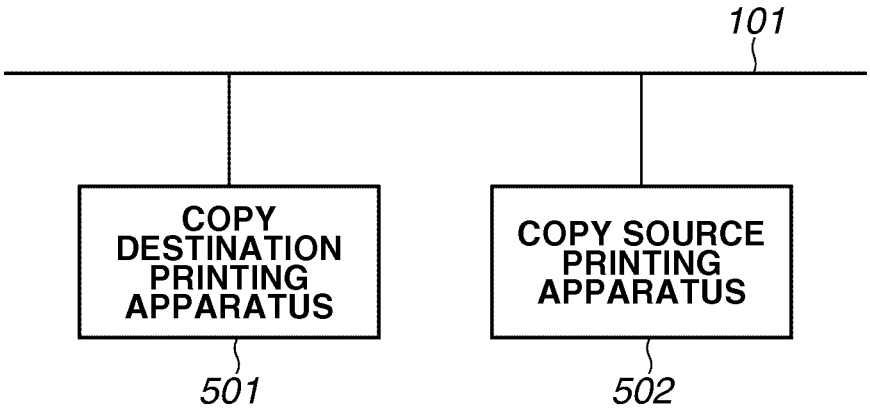
FIG. 5 is a schematic diagram illustrating a connection configuration of a copy source printing apparatus of sheet storage unit group settings and a copy destination printing apparatus of sheet storage unit group settings according to an exemplary embodiment of the present invention.

FIG. 5 is a schematic diagram illustrating a relationship between two sets of the printing apparatuses of a printing apparatus serving as a copy source of the sheet storage unit group settings and a printing apparatus serving as a copy destination thereof. In FIG. 5, the situation in which a printing apparatus 501 and a printing apparatus 502 are connected via the communication line 101 is illustrated.

In the present exemplary embodiment, an example of copying the sheet storage unit grouping settings from the printing apparatus 502 to the printing apparatus 501 will be described, but the printing apparatus of a copy source and the printing apparatus of a copy destination can be changed with each other. In other words, the printing apparatus may be operable as either a copy source or a copy destination of the sheet storage unit group settings.

Further, a plurality of printing apparatuses other than the printing apparatus 501 and the printing apparatus 502 and information processing apparatuses such as personal computers (PC) (not illustrated) may be connected over the communication line, and these apparatuses can communicate with one another.

In descriptions below, hardware configuration/software configuration of the printing apparatus 501 and the printing apparatus 502 are assumed to be similar to those described in FIGS. 1 and 2, and descriptions will be given using the same reference numerals.

Figure 6:
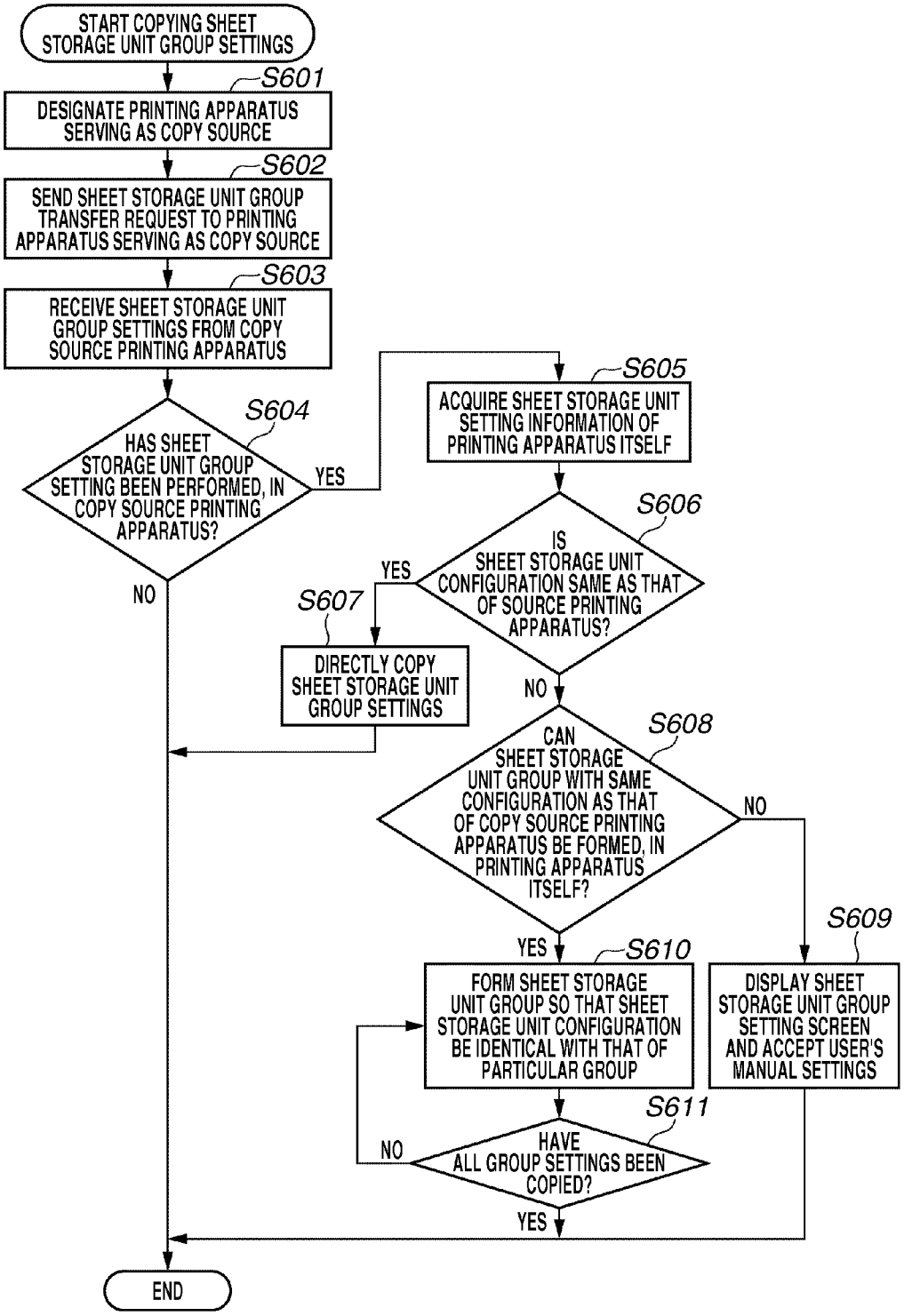
FIG. 6 is a flowchart illustrating an operation of a copy destination printing apparatus of sheet storage unit group settings according to a first exemplary embodiment of the present invention.

FIG. 6 is a flowchart illustrating an operation when the sheet storage unit group settings are copied, in the printing apparatus 501 serving as the copy destination of the sheet storage unit group settings.

Respective steps in FIG. 6 are implemented by the CPU 114 executing the control programs (e.g., respective software modules in FIG. 2) stored in the ROM 112 or the HDD 115 and read out in the RAM 113 in the printing apparatus 501.

Figure 8:
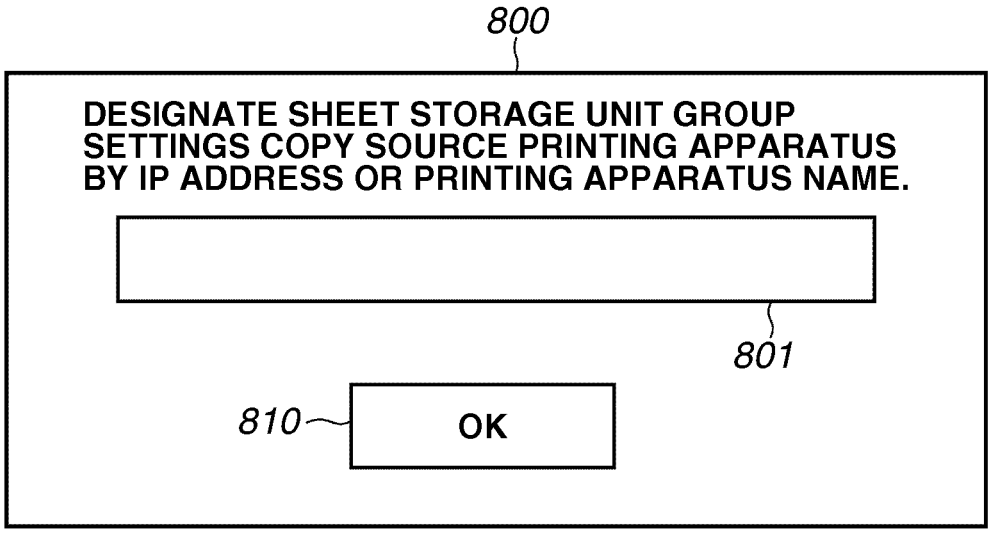
FIG. 8 is a schematic diagram illustrating an example of a menu screen on which the copy source printing apparatus of sheet storage unit group settings is designated according to an exemplary embodiment of the present invention.

First, in step S601, the sheet storage unit grouping setting copying unit 203 accepts designation of a printing apparatus serving as a copy source, in the printing apparatus 501. The designation of the printing apparatus is performed by the user, by displaying a dialog as illustrated in FIG. 8 on the operation panel of the printing apparatus 501. In this case, descriptions will be made assuming that the printing apparatus 502 has been selected as the copy source printing apparatus.

Next in step S602, the sheet storage unit grouping setting copying unit 203 of the printing apparatus 501 requests the printing apparatus 502 serving as the copy source printing apparatus to transfer the sheet storage unit group settings. An operation of the printing apparatus 502 which has received the request to transfer the sheet storage unit group settings will be described below with reference to FIG. 7.

Next in step S603, the sheet storage unit group setting reception unit 205 of the printing apparatus 501 receives the sheet storage unit group settings transferred from the printing apparatus 502.

In step S604, it is determined whether the sheet storage unit groups have been set, in the printing apparatus 502 serving as the copy source printing apparatus.

If the sheet storage unit group settings have not been performed (NO in step S604), since there are no sheet storage unit group settings, copying processing of the sheet storage unit group settings directly ends. At that time, an alert display on the operation panel, to notify the user that the sheet storage unit group settings have not been copied, may be performed.

On the other hand, if the sheet storage unit group settings exist in the printing apparatus 502 serving as the copy source printing apparatus (YES in step S604), in step S605, the printing apparatus 501 acquires sheet storage unit information of the printing apparatus itself, by the sheet storage unit information acquisition unit 202.

The sheet storage unit information to be acquired in step S605 is paper information such as paper sizes, paper types set in the respective sheet storage units, and information in at least columns 401, 402, and 403 in FIG. 4.

Next in step S606, the comparison is performed on the sheet storage unit configurations of the printing apparatus 501 and the printing apparatus 502, based on the sheet storage unit group settings of the printing apparatus 502 received in step S603, and the sheet storage unit information of the printing apparatus itself acquired in step S605. Thus, it is determined whether the sheet storage unit configurations of the printing apparatus 501 and the printing apparatus 502 are the same as each other.

If the sheet storage unit configurations of the printing apparatus 501 and the printing apparatus 502 are the same as each other (YES in step S606), in step S607, the sheet storage unit group settings of the printing apparatus 502 are copied as it is to the printing apparatus 501, and the processing ends.

In this case, information indicating that the sheet storage unit configuration has been copied may be displayed on the operation panel of the printing apparatus 501. The fact that the sheet storage unit configurations are the same as each other means that paper information of the sheets (e.g., paper sizes and paper types) stored in the sheet storage units with the same number are entirely the same as each other. However, the user may arbitrarily set a criterion to determine that the sheet storage unit configurations are the same as each other.

The user may set, not only a criterion in which all of the paper information are the same, but also, for example, such a criterion as "it is determined as the same if at least any one is the same", or "it is determined as the same if at least paper size is the same".

If there exists even one sheet storage unit in which sheets having different paper information are stored in sheet storage units having the same number, in the printing apparatus 501 and in the printing apparatus 502 (NO in step S606), the processing proceeds to step S608.

In step S608, it is determined whether a sheet storage unit group with the same configuration as that of the printing apparatus 502 can be formed in the printing apparatus 501. The sheet storage unit group with the same configuration means that paper information of the sheets stored in the sheet storage units which belong to the sheet storage unit group is the same as each other.

At that time, it is important that the sheet storage unit numbers do not necessarily need to be the same. For example, the sheet storage unit group settings in the printing apparatus 502 are assumed to be the ones illustrated in FIG. 4.

In this case, in order for the printing apparatus 501 to form the sheet storage unit groups with the same configuration, the printing apparatus 501 may include three stages of sheet storage units storing A4-plain paper, two stages of sheet storage units storing A3-thick paper, one stage of a sheet storage unit storing LTR-plain paper, and two stages of sheet storage units storing LTR-coated paper.

With this configuration, it is possible to form the sheet storage unit groups 1 to 3 with the same configuration as that of the sheet storage unit group settings illustrated in FIG. 4, in the printing apparatus 501.

If the sheet storage unit groups with the same configuration as that of the printing apparatus 502 cannot be formed in the printing apparatus 501 (NO in step S608), in step S609, the printing apparatus 501 accepts manual sheet storage unit group settings from the user using the sheet storage unit group setting unit 201.

On the other hand, in step S608, if the sheet storage unit group with the same configuration as that of the printing apparatus 502 can be formed in the printing apparatus 501

(YES in step S608), automatic copying of the sheet storage unit group settings is performed.

The automatic copying is copying the sheet storage unit group settings by forming a sheet storage unit group so that the sheet configurations stored in the sheet storage units included in the sheet storage unit group become identical with each other.

First, in step S610, from the sheet storage unit group 1 of the sheet storage unit groups of the printing apparatus 502, the sheet storage unit group is formed in the printing apparatus 501 so that the sheet storage unit configuration is identical with that of the sheet storage unit group 1.

If not copied sheet storage unit groups remain (NO in step S611), the processing returns to step S610, and automatic copying of the remaining sheet storage unit groups is continued.

If all sheet storage unit groups have been automatically copied (YES in step S611), the processing ends. Herein, information indicating that the sheet storage unit configuration has been copied may be displayed on the operation panel in the printing apparatus 501.

Figure 7:
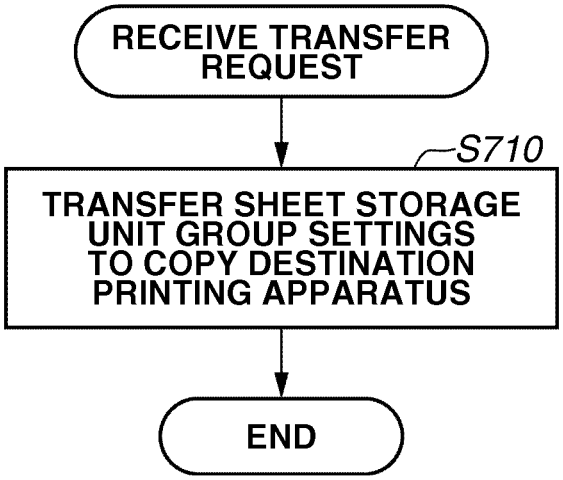
FIG. 7 is a flowchart illustrating an operation of the copy source printing apparatus of sheet storage unit group settings according to an exemplary embodiment of the present invention.

FIG. 7 is a flowchart illustrating an operation when a transfer request of the sheet storage unit group settings has been received from the printing apparatus 501, in the printing apparatus 502 serving as copy source of the sheet storage unit group settings.

Respective steps in FIG. 7 are implemented by the CPU 114 executing the control programs (e.g., respective software modules in FIG. 2) stored in the ROM 112 or the HDD 115 and read out in the RAM 113 in the printing apparatus 502. Especially the processing flow is performed after step S602 in FIG. 6.

The printing apparatus 502, upon receiving the transfer request of the sheet storage unit group settings, reads out the sheet storage unit group settings stored in the RAM 113, the HDD 115, or the NVRAM.

Then in step S710, the printing apparatus 502 transfers the sheet storage unit group settings to the printing apparatus 501 by using the sheet storage unit group setting transfer unit 204. In the printing apparatus 501, the sheet storage unit group setting reception unit 205 receives the sheet storage unit group settings transferred from the printing apparatus 502 in step S603, and continues the processing of step S604 and subsequent steps.

FIG. 8 is an example of a menu screen to be displayed on the operation panel in order for the printing apparatus 501 to designate a printing apparatus serving as copy source of the sheet storage unit grouping settings, in step S601 in FIG. 6. This screen is displayed in response to a predetermined operation performed by the user to the printing apparatus 501.

A full menu screen 800 is displayed on the operation panel 120. The user can input information for identifying a printing apparatus which the user desires into a text box 801 by operating the operation panel 120.

Herein, although an example of designation using an Internet Protocol (IP) address or a printing apparatus name of the printing apparatus is illustrated, after searching for a plurality of printing apparatuses connected over the communication line 101 and displaying a list, the user may select a desired printing apparatus from the list. Alternatively, printing apparatuses which have been registered in advance in the printing apparatus 501 may be displayed.

An OK button 810, when pressed, determines the current designations on the menu screen 800, and closes the menu screen 800. In this manner, the printing apparatus 501 can accept designation of the printing apparatus serving as the copy source of the sheet storage unit grouping settings from the user.

Hereinbelow, supplemental descriptions of the processing according to the flowchart illustrated in FIG. 6 will be given, taking specific examples (three examples in FIGS. 9A to FIG. 9C) with reference to FIGS. 9A to 9C. In descriptions referring to FIG. 9A to 9C, as a premise, the sheet storage unit group settings of the printing apparatus 502 received in step S603 are assumed to be the ones illustrated in FIG. 4.

In FIG. 9A, a column 901 illustrates the sheet storage unit numbers of the printing apparatus 501. A column 902 and a column 903 illustrate paper sizes and paper types set for the respective sheet storage units in the printing apparatus 501, respectively.

A column 904 illustrates the sheet storage unit group numbers set for the respective sheet storage units, as a result that the sheet storage unit group settings of the printing apparatus 502, in this case, the settings in FIG. 4 have been copied, in the printing apparatus 501.

How the sheet storage unit group numbers illustrated in the column 904 have been selected will be described, using the steps illustrated in FIG. 6.

In step S606, since the sheet storage unit configuration of the printing apparatus 502 illustrated in FIG. 4, and the sheet storage unit configuration of the printing apparatus 501 illustrated in FIG. 9A are the same as each other (YES in step S606), the processing proceeds to step S606. Next in step S607, the sheet storage unit group settings of the printing apparatus 502 are copied without change. As a result, the sheet storage unit group settings in the printing apparatus 501 become the ones illustrated in the column 904.

In FIG. 9B, a column 911 illustrates sheet storage unit numbers of the printing apparatus 501. A column 912 and a column 913 illustrate paper sizes and paper types set for the respective sheet storage units in the printing apparatus 501, respectively.

A column 914 illustrates sheet storage unit group numbers set for the respective sheet storage units, as a result that the sheet storage unit group settings of the printing apparatus 502, in this case, the settings in FIG. 4 have been copied in the printing apparatus 501.

How the sheet storage unit group settings illustrated in the column 914 have been obtained, will be described using the steps illustrated in FIG. 6. In step S606, since the sheet storage unit configuration of the printing apparatus 502 illustrated in FIG. 4, and the sheet storage unit configuration of the printing apparatus 501 illustrated in FIG. 9B are different from each other (NO in step S606), the processing proceeds to step S608.

Next in step S608, it is determined whether the sheet storage unit groups with the same configuration as that of the printing apparatus 502 can be formed in the printing apparatus 501.

As illustrated in FIG. 9B, the sheet storage unit configuration of the printing apparatus 501 includes three stages of A4-plain paper, one stage of A4-thick paper, one stage of A3-plain paper, two stages of A3-thick paper, and one stage of LTR-coated paper, and thus the sheet storage unit groups with similar configuration to that of the printing apparatus 502 cannot be formed (NO in step S608), and therefore the processing proceeds to step S609.

Next in step S609, the printing apparatus 501 accepts manual sheet storage unit group settings from the user using the sheet storage unit group setting unit 201, and the result is employed as the sheet storage unit grouping settings in the printing apparatus 501.

In FIG. 9C, a column 921 illustrates the sheet storage unit numbers of the printing apparatus 501. A column 922 and a column 923 illustrate respectively paper sizes and paper types set for the respective sheet storage units, in the printing apparatus 501.

A column 924 illustrates sheet storage unit group numbers set for respective sheet storage units, as a result that the sheet storage unit group settings of the printing apparatus 502, in this case, the settings in FIG. 4 have been copied in the printing apparatus 501. How the sheet storage unit group numbers illustrated in the column 924 have been selected will be described, using the steps illustrated in FIG. 6.

In step S606, since the sheet storage unit configuration of the printing apparatus 502 illustrated in FIG. 4 and the sheet storage unit configuration of the printing apparatus 501 illustrated in FIG. 9C are different from each other (NO in step S606), the processing proceeds to step S608. Next in step S608, it is determined whether the sheet storage unit groups with the same configuration as that of the printing apparatus 502 can be formed, in the printing apparatus 501.

As illustrated in FIG. 9C, the sheet storage unit configuration of the printing apparatus 501 includes three stages of A4-plain paper, two stages of A3-thick paper, one stage of LTR-plain paper, and two stages of LTR-coated paper, and is the same as the sheet storage unit configuration of the printing apparatus 502.

Therefore, in step S608, it is determined that the sheet storage unit groups with the same configuration as that of the printing apparatus 502 can be formed in the printing apparatus 501 (YES in step S608), and automatic copying of the sheet storage unit groups is performed.

Next, the processing proceeds to step S610, and first, the sheet storage unit group 1 of the printing apparatus 502 is copied. More specifically, the sheet storage unit 1, the sheet storage unit 2, and the sheet storage unit 5 storing therein A4-plain paper are set for the sheet storage unit group 1 in the printing apparatus 501 so that the sheet storage unit configuration is the same as that of the sheet storage unit group 1.

Next the processing proceeds to copying of the sheet storage unit group 2 of the printing apparatus 502. In this process, the sheet storage unit 4 and the sheet storage unit 7 storing therein A3-thick paper are set for the sheet storage unit group 2 in the printing apparatus 501 so that the sheet storage unit configuration is the same as that of the sheet storage unit group 2.

Next the processing proceeds to copying operation of the sheet storage unit group 3 of the printing apparatus 502. In this process, the sheet storage unit 6 storing therein LTR-plain paper, and the sheet storage unit 3 and the sheet storage unit 8 storing therein LTR-coated paper are set for the sheet storage unit group 3 in the printing apparatus 501 so that the sheet storage unit configuration is the same as that of the sheet storage unit group 3. As a result, the sheet storage unit group settings in the printing apparatus 501 become as the ones illustrated in the column 924.

In the present exemplary embodiment, copying operation of the sheet storage unit group settings between the printing apparatuses is performed, according to the processing as described above. Through such processing, even when arrangements of the sheet storage units are different between the copy source printing apparatus and the copy destination printing apparatus, it becomes possible to automatically copy the sheet storage unit group settings, so that configurations of the sheets in the sheet storage units which belong to the sheet storage unit group become the same as each other.

This can save troublesome work of performing settings of the sheet storage unit groups, in a case where there is a plurality of printing apparatuses, thereby enhancing convenience.

In the first exemplary embodiment, in step S608 in FIG. 6, if it is determined that a sheet storage unit group with the same configuration as that of the printing apparatus 502 cannot be formed in the printing apparatus 501, the printing apparatus 501 accepts manual sheet storage unit grouping settings from the user using the sheet storage unit group setting unit 201.

On the other hand, in a second exemplary embodiment of the present invention, even if it is determined that a sheet storage unit group with the same configuration as that of the copy source printing apparatus cannot be formed in the copy destination printing apparatus of the sheet storage unit group settings, forced copying of the sheet storage unit group settings of the copy source in the copy destination can be performed.

Further, with regard to sheet storage units whose sheet storage unit configuration will become different from that of the copy source printing apparatus, as a result that the sheet storage unit group settings have been forcedly copied, the user is notified so as to be able to determine at a glance sheets in which sheet storage unit should be replaced with which sheets.

In the present exemplary embodiment, part different from the first exemplary embodiment will be described, and the components with the same configuration will be described using the identical reference numerals. A hardware configuration and software module configuration of a printing apparatus according to the second exemplary embodiment are respectively similar to those illustrated in FIGS. 1 and 2 in the first exemplary embodiment.

Also in the present exemplary embodiment, similar to the example illustrated in FIG. 5, flow of the processing when the sheet storage unit group settings are copied from the printing apparatus 502 to the printing apparatus 501 will be described.

Figure 10:
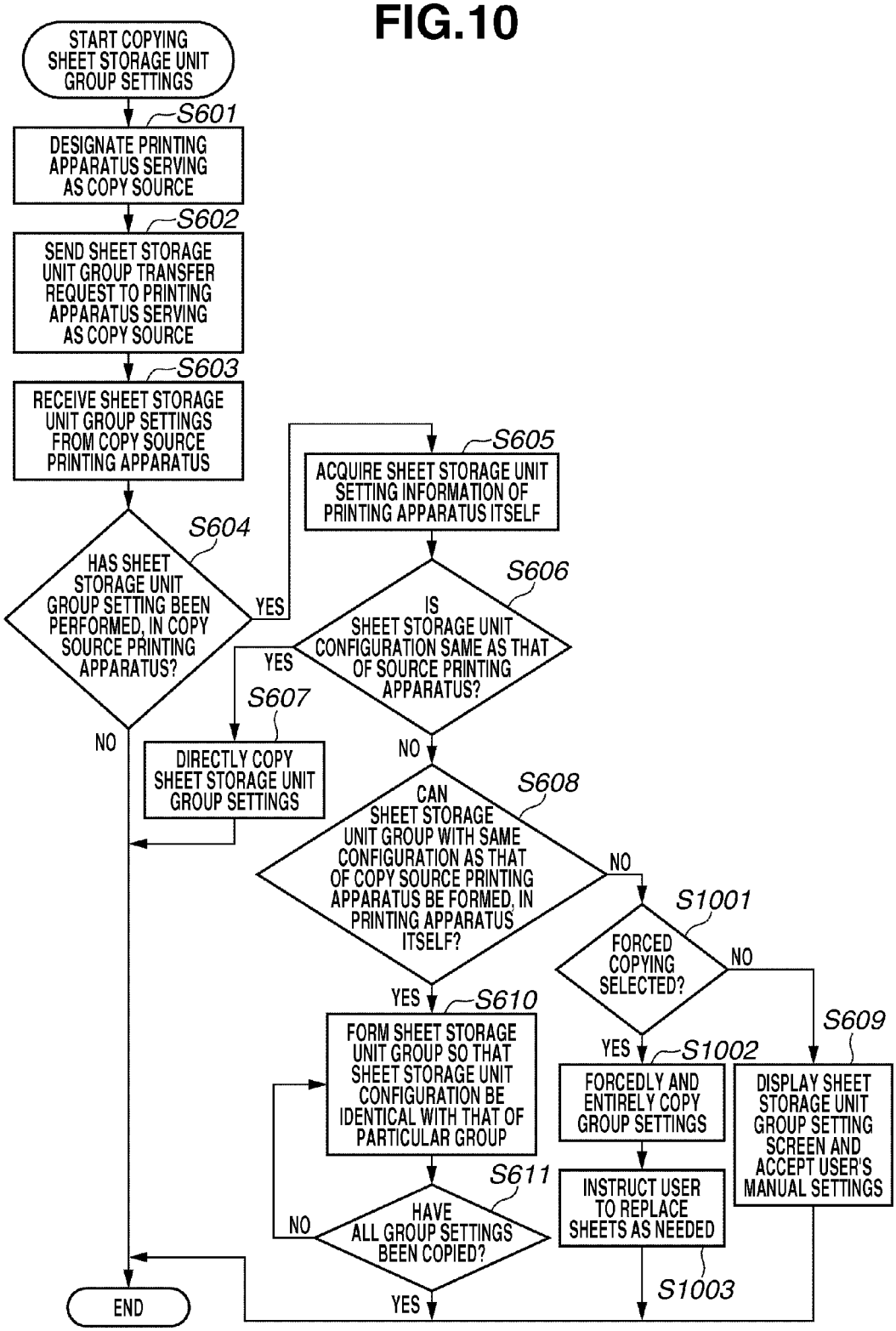
FIG. 10 is a flowchart illustrating an operation of a copy destination printing apparatus of sheet storage unit group settings according to a second exemplary embodiment of the present invention.

FIG. 10 is a flowchart illustrating an operation when the sheet storage unit group settings are copied in the printing apparatus 501 serving as the copy destination of the sheet storage unit group settings.

Respective steps in FIG. 10 are implemented by the CPU 114 executing the control programs (e.g., respective software modules in FIG. 2) stored in the ROM 112 or the HDD 115 and read out in the RAM 113 in the printing apparatus 501.

Since the steps from step S601 to step S611 in FIG. 10 are similar to the steps from step S601 to step S611 in FIG. 6, descriptions thereof will not be repeated.

In step S608 in the flow, if it is determined that sheet storage unit groups with the same configuration as that of the printing apparatus 502 cannot be formed in the printing apparatus 501 (NO in step S608), the processing proceeds to step S1001.

In step S1001, the sheet storage unit grouping setting copying unit 203 of the printing apparatus 501 allows the user to select whether to forcedly copy the sheet storage unit group settings of the printing apparatus 502.

Figure 11:
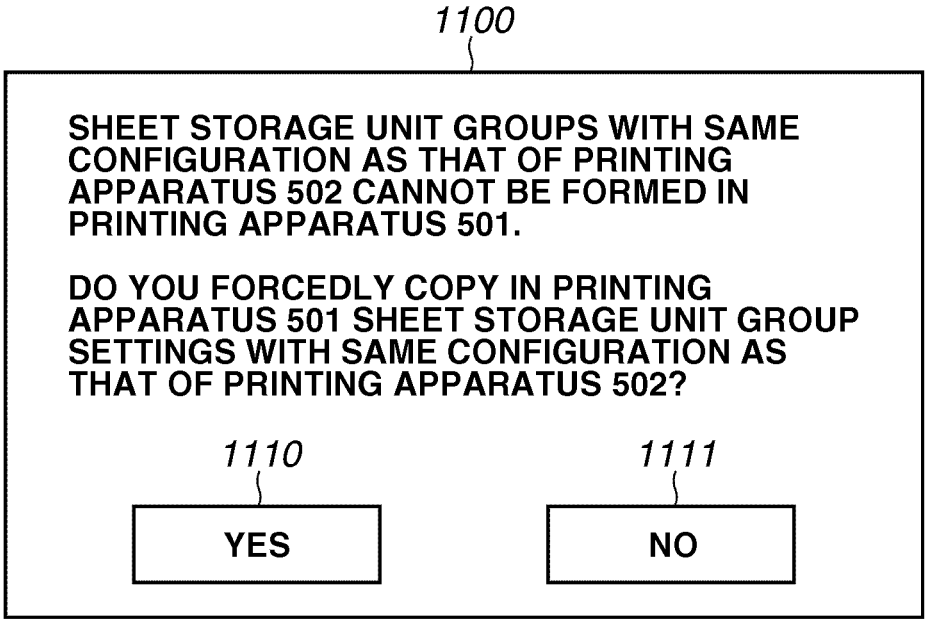
FIG. 11 is a schematic diagram illustrating an example of a menu screen according to the second exemplary embodiment of the present invention.

Then, it is determined whether forced copying of the sheet storage unit group settings of the printing apparatus 502 to the printing apparatus 501 has been selected by the user. The selection whether to forced copying is performed by the user, by displaying the dialog as illustrated in FIG. 11 on the operation panel in the printing apparatus 501.

If the user has selected the option not to perform forced copying (NO in step S1001), in step S609, the printing apparatus 501 accepts manual sheet storage unit group settings from the user using the sheet storage unit group setting unit 201.

On the other hand, if the user has selected the option to perform forced copying (YES in step S1001), in step S1002, the sheet storage unit group settings of the printing apparatus 502 are directly copied in the printing apparatus 501.

Figure 12:
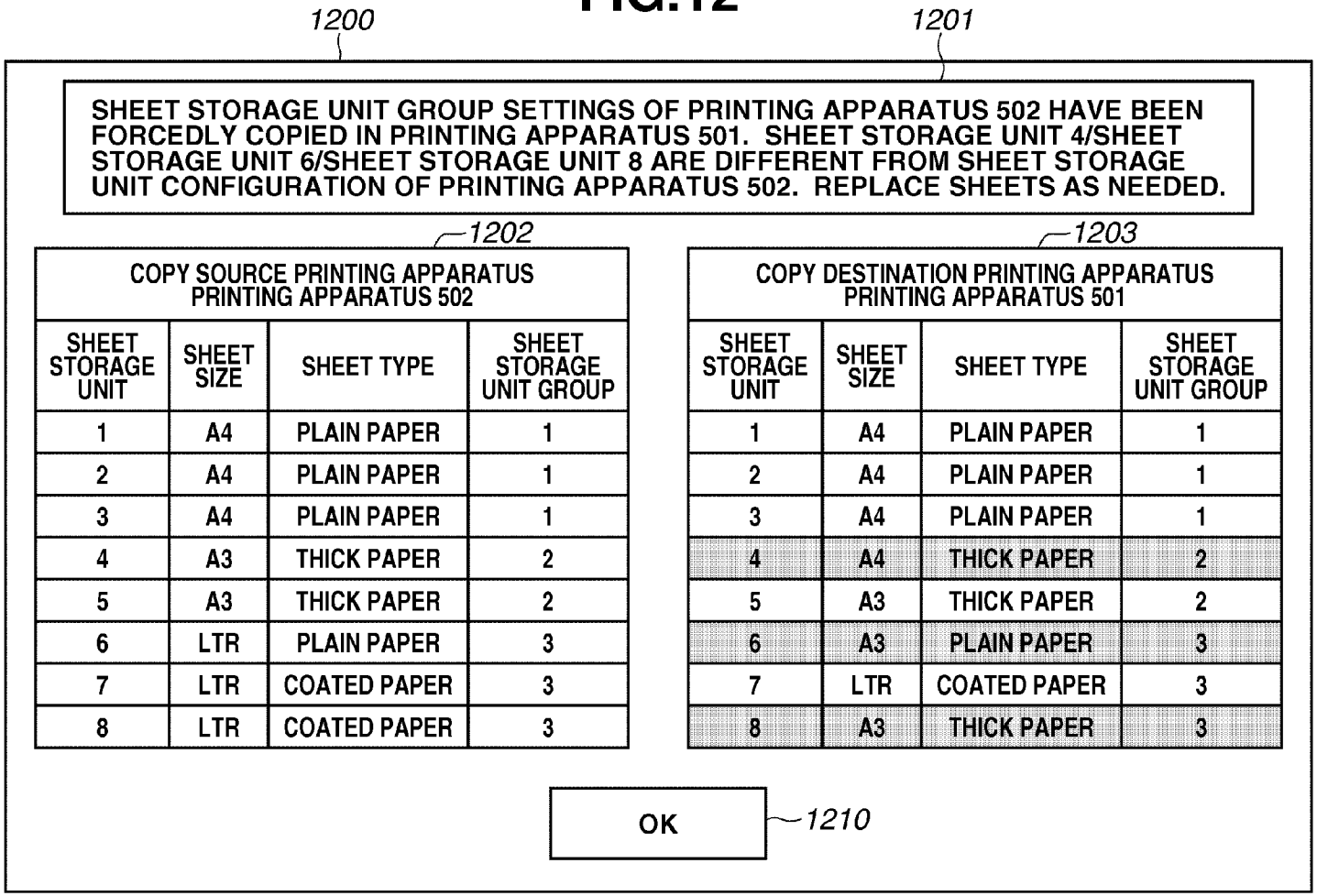
FIG. 12 is a schematic diagram illustrating an example of a message screen according to the second exemplary embodiment of the present invention.

Next, in step S1003, the sheet storage unit grouping setting copying unit 203 displays a screen such as the one illustrated in FIG. 12 on the operation panel 120, and notifies the user to replace the sheets stored in the sheet storage units as needed, and ends the processing.

FIG. 11 is an example of a menu screen which the printing apparatus 501 displays for allowing the user to select whether to perform forced copying of the sheet storage unit group settings of the printing apparatus 502 in step S1001.

A full menu screen 1100 is displayed on the operation panel 120. The user presses a button 1110 to perform forced copying, and presses a button 1111 not to perform forced copying. In this manner, the printing apparatus 501 can accept an instruction whether to perform forced copying of the sheet storage unit group settings.

FIG. 12 is an example of a message screen to be displayed for the user, in step S1003. A full message screen 1200 is displayed on the operation panel 120.

FIG. 12 illustrates an example in a case where the sheet storage unit group settings of the printing apparatus 502 are identical with the ones illustrated in FIG. 4, and the sheet storage unit information of the printing apparatus 501 is identical with the one in the columns 911 to 913 illustrated in FIG. 9B.

A message 1201 is notified to the user. In the message 1201, it is notified that the sheet storage unit 4, the sheet storage unit 6, and the sheet storage unit 8 in the printing apparatus 501 are different from the sheet storage unit configuration of the printing apparatus 502.

A table 1202 illustrates the sheet storage unit group settings of the printing apparatus 502, and a table 1203 illustrates the sheet storage unit group settings of the printing apparatus 501.

In the table 1203, the sheet storage unit 4, the sheet storage unit 6, and the sheet storage unit 8 are highlightedly displayed, and it is notified that they are different from the sheet storage unit configuration of the printing apparatus 502. When an OK button 1210 is pressed, the message screen 1200 is closed.

By thus displaying the message screen, it is possible to notify the user of the sheet storage units of which sheet storage unit configuration has become different from that of the copy source printing apparatus, as a result that the sheet storage unit group settings have been forcedly copied.

As a way to notify the sheet storage units of which sheet storage unit configuration has become different from that of the copy source printing apparatus, it is not limited to highlightedly display in FIG. 12, but all modifications are possible.

According to the second exemplary embodiment as described above, even if it is determined that the sheet storage unit groups with the same configuration as that of the copy source printing apparatus cannot be formed in the copy destination printing apparatus of the sheet storage unit group settings, the sheet storage unit group settings of the copy source can be forcedly copied.

Further, it is possible to notify the user of the sheet storage units of which sheet storage unit configuration has become different from that of the copy source printing apparatus, as a result that the sheet storage unit group settings have been forcedly copied. This enables the user to determine at a glance sheets in which sheet storage unit should be replaced with which sheets, thereby enhancing convenience.

In the first exemplary embodiment, if it is determined that the sheet storage unit groups with the same configuration as that of the copy source printing apparatus cannot be formed in the copy destination printing apparatus of the sheet storage unit group settings, the copy destination printing apparatus accepts manual sheet storage unit group settings from the user. However, even in this case, there exist cases where some groups of a plurality of sheet storage unit groups of the copy source printing apparatus can be copied.

Therefore, in a third exemplary embodiment, even if it is determined that the sheet storage unit groups with the same configuration as that of the copy source printing apparatus cannot be formed in the copy destination printing apparatus, an example of allowing some copyable settings of the sheet storage unit group settings to be copied will be described.

In the present exemplary embodiment, portions different from those in the first exemplary embodiment will be described, and components with the same configuration will be described using identical reference numerals. A hardware configuration and software module configuration of a printing apparatus according to the third exemplary embodiment are similar to those illustrated in FIG. 1 and FIG. 2 according to the first exemplary embodiment of the present invention, respectively.

Further, even in the present exemplary embodiment, similar to the example described referring to FIG. 5, flow of the processing when the sheet storage unit group settings are copied from the printing apparatus 502 to the printing apparatus 501 will be described.

Figure 13:
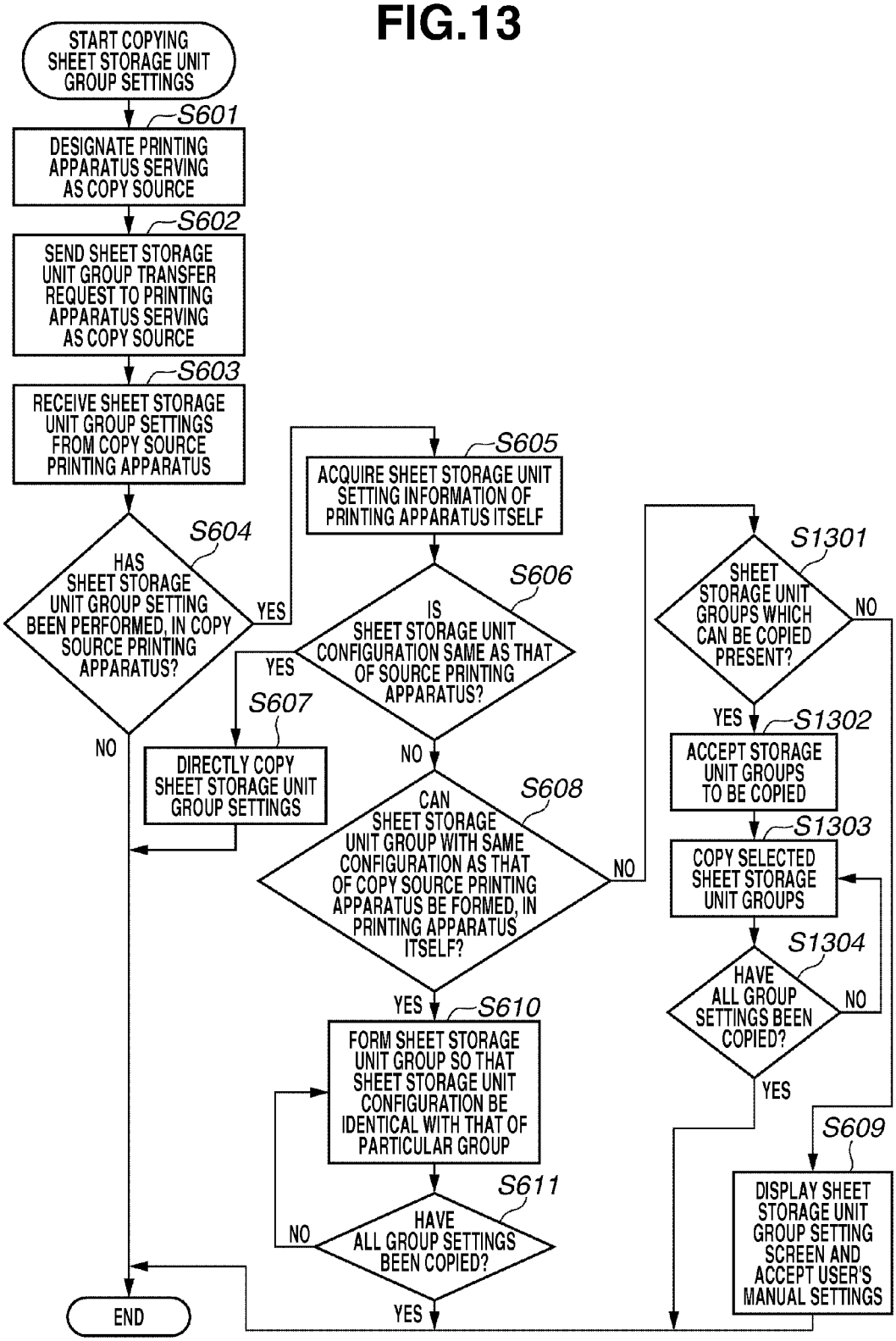
FIG. 13 is a flowchart illustrating an operation of a copy destination printing apparatus of sheet storage unit group settings according to a third exemplary embodiment of the present invention.

FIG. 13 is a flowchart illustrating an operation when the sheet storage unit group settings are copied in the printing apparatus 501 serving as the copy destination of sheet storage unit group settings.

Respective steps in FIG. 13 are implemented by the CPU 114 executing the control programs (e.g., respective software modules FIG. 2), stored in the ROM 112 or the HDD 115 and read out in the RAM 113 in the printing apparatus 501.

Since the steps from step S601 to step S611 in FIG. 13 are similar to the steps from step S601 to step S611 in FIG. 6, descriptions thereof will not be repeated.

In step S608 in the flow, if it is determined that the sheet storage unit groups with the same configuration as that of the printing apparatus 502 cannot be formed in the printing apparatus 501 (NO in step S608), the processing proceeds to step S1301. In step S1301, it is confirmed whether there exist sheet storage unit groups with the same configuration as that of the printing apparatus 502 which can be formed in the printing apparatus 501, of the sheet storage unit groups set for the printing apparatus 502.

In step S1301, if it is determined that copyable sheet storage unit groups are not present (NO in step S1301), in step S609, the printing apparatus 501 accepts manual sheet storage unit grouping settings from the user using the sheet storage unit group setting unit 201.

On the other hand, in step S1301, if it is determined that copyable sheet storage unit groups are present (YES in step S1301), in step S1302, the printing apparatus 501 accepts from the user selection of sheet storage unit groups to be copied of these copyable sheet storage unit groups.

Figure 14:
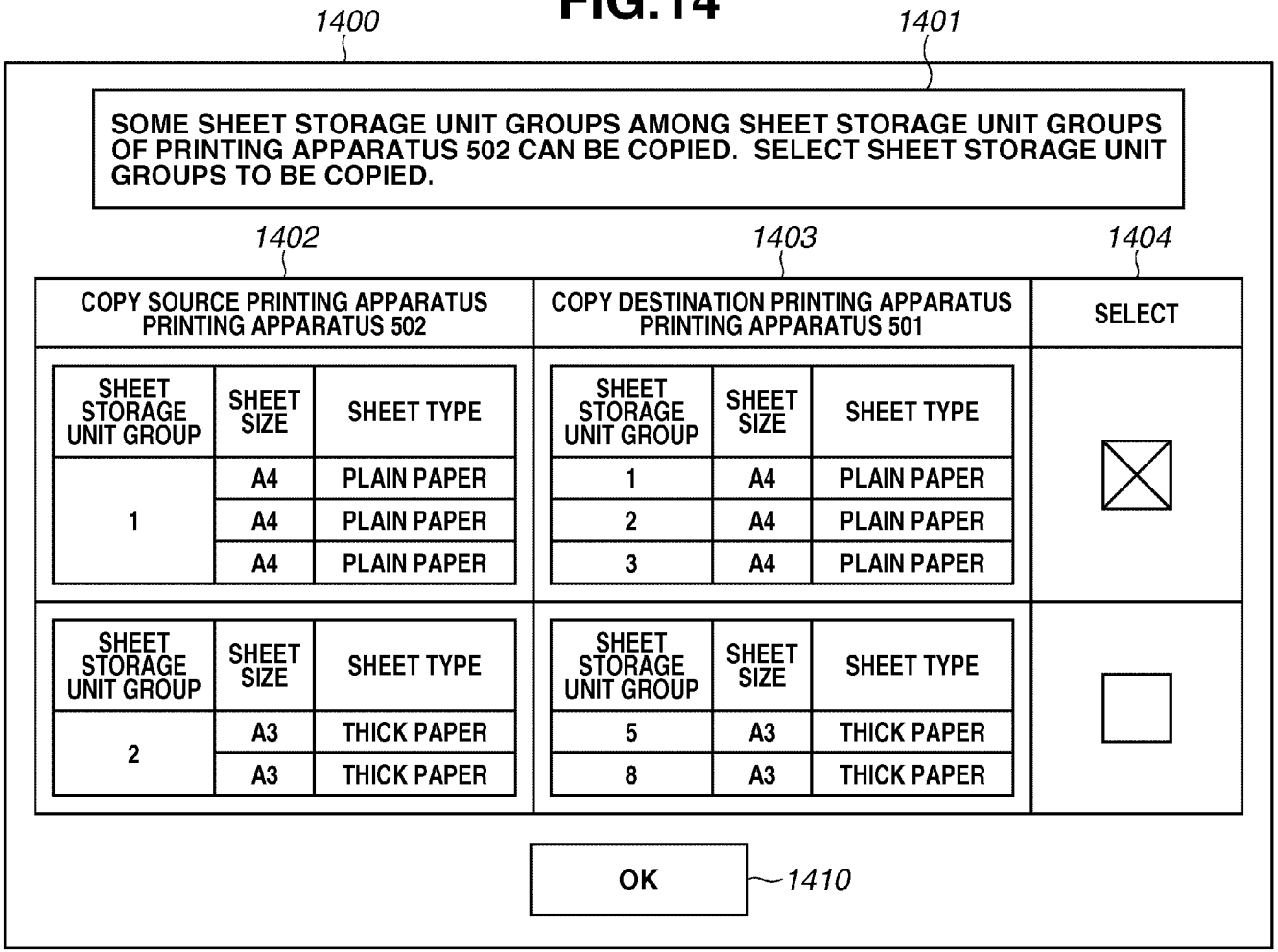
FIG. 14 is a schematic diagram illustrating an example of a menu screen according to the third exemplary embodiment of the present invention.

The selection of the sheet storage unit groups is performed by the user, by displaying a dialog such as the one illustrated in FIG. 14 on the operation panel in the printing apparatus 501.

In step S1302, if the sheet storage unit groups to be copied have been selected by the user, in step S1303, the sheet storage unit grouping setting copying unit 203 forms the sheet storage unit groups so that the sheet storage unit configuration thereof becomes identical with that of the selected sheet storage unit groups.

If not copied sheet storage unit groups remain, of the selected sheet storage unit groups (NO in step S1304), the processing returns to step S1303, and copying operation of the remaining sheet storage unit groups is continued. When all thus selected sheet storage unit groups have been automatically copied (YES in step S1304), the processing ends.

FIG. 14 illustrates an example of a menu screen to be displayed on the operation panel in order for the printing apparatus 501 to accept from the user selection instructions of the sheet storage unit groups to be copied from the printing apparatus 502 to the printing apparatus 501 in step S1302. A full menu screen 1400 is displayed on the operation panel 120.

FIG. 14 illustrates an example in which the sheet storage unit group settings of the printing apparatus 502 are identical with the settings illustrated in FIG. 4, and the sheet storage unit setting information of the printing apparatus 501 is identical with the ones indicated in the columns 911 to 913 in FIG. 9B.

A message 1401 is notified to the user. A column 1402 displays sheet storage unit groups copyable in the printing apparatus 501, of the sheet storage unit groups set for the printing apparatus 502.

In FIG. 14, a sheet storage unit group 1 and a sheet storage unit group 2 are displayed as copyable sheet storage unit groups. With this, it is found that a sheet storage unit group 3 is not copyable due to the sheet storage unit configuration of the printing apparatus 501.

A column 1403 illustrates sheet storage unit groups formed in the printing apparatus 501 corresponding to the sheet storage unit groups displayed in the column 1402.

In FIG. 14, it is illustrated that the sheet storage unit 1, the sheet storage unit 2, and the sheet storage unit 3 are grouped as a sheet storage unit group, if the sheet storage unit group 1 has been copied in the printing apparatus 501.

Further, in FIG. 14, it is illustrated that the sheet storage unit 5 and the sheet storage unit 8 are grouped as a sheet storage unit group, if the sheet storage unit group 2 has been similarly copied in the printing apparatus 501.

In a column 1404, check boxes are displayed for designating whether to perform copying in the printing apparatus 501, with respect to respective sheet storage unit group settings. By checking these check boxes, the user can select sheet storage unit groups as a copy target.

An OK button 1410, when pressed, determines current settings of a menu screen 1400, and closes the menu screen 1400.

The screen in FIG. 14 is only an example, and various modifications are possible as long as the screen allows the user to identify copyable sheet storage unit groups, identify non-copyable sheet storage unit group, and to select sheet storage unit groups to be copied.

In this manner, according to the third exemplary embodiment, since it becomes possible to selectively copy some copyable sheet storage unit group settings of a plurality of sheet storage unit groups, degree of freedom for the user is increased, and convenience is further enhanced.

In the descriptions of the above-described exemplary embodiments, the copy source printing apparatus is configured to transmit sheet storage unit group settings to be copied, in response to a request from the copy destination printing apparatus. In other words, a pull-type delivery from the copy destination printing apparatus, using the screen in FIG. 8, is assumed.

However, on the contrary, the copy destination printing apparatus maybe selected from the copy source printing apparatuses, and the sheet storage unit group settings may be transmitted to the selected copy destination printing apparatus. More specifically, a screen for selecting a transmission destination apparatus of the sheet storage unit group settings maybe displayed in the copy source printing apparatus, and the user may arbitrarily select a copy destination printing apparatus.

Further, in that case, instead of copying the sheet storage unit group settings in one-to-one relationship such as the one illustrated in FIG. 5, the user may select a plurality of sets of printing apparatuses as the copy destination printing apparatuses from one copy source printing apparatus.

Then, the sheet storage unit group settings may be collectively transmitted to and copied in the plurality of sets of printing apparatuses. This will further reduce time and work of the users.

Although apparatuses which transmit the sheet storage unit group settings are printing apparatuses in the descriptions of the above-described exemplary embodiments, an information processing apparatus such as a server may retain the sheet storage unit group settings, and the sheet storage unit group settings may be transmitted from this server to arbitrary printing apparatuses.

In other words, sheet storage unit group settings which have been in a relationship between a printing apparatus and a printing apparatus in the above-described exemplary embodiments, can be also similarly implemented as a relationship between information processing apparatus such as a server and a printing apparatus.

In addition to grouping of the sheet storage units, setting of a special sheet storage unit which belongs to any sheet storage unit group may be enabled. If such a special sheet storage unit is set, the user may be allowed to arbitrary select whether to include the special sheet storage unit too in the sheet storage unit group settings to take it as a copy target.

In the above-described exemplary embodiments, although descriptions have been given assuming that numbers of the sheet storage units are identical with each other in the copy source printing apparatus and the copy destination printing apparatus, the numbers of the sheet storage units may be different between the printing apparatuses.

With the method especially described in the third exemplary embodiment, it is possible to copy some of the sheet storage unit group settings. As a result, even when the numbers of the sheet storage units are different, it is possible to respond flexibly thereto.

In the above-described exemplary embodiments, copying the sheet storage unit group settings includes not only overwriting information of the copy destination with information of the copy source, but also a management method of retaining the information of the copy source (valid information) as the information to be used, keeping old information of the copy destination retained.

Further, the above-described exemplary embodiments can be arbitrarily combined with each other. For example, it is also possible to perform operations according to the flowcharts in FIG. 6, FIG. 10, and FIG. 13 together in one printing apparatus.

Aspects of the present invention can also be realized by a computer of a system or apparatus (or devices such as a CPU, a micro processing unit (MPU), and/or the like) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., a computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-091165 filed Apr. 15, 2011, which is hereby incorporated by reference herein in its entirety.

What is claimed is:

1. A printing apparatus having a plurality of sheet storage units that stores sheets to be supplied to a printing unit, the printing apparatus comprising:

a reception unit configured to receive, from an external printing apparatus in which a sheet storage unit group constituted by arbitrary sheet storage units of a plurality of sheet storage units has been formed, sheet storage unit group settings of the external printing apparatus including paper information that is information of sheets stored in respective sheet storage units that constitute the sheet storage unit group;

a determination unit configured to determine whether a sheet storage unit group with a same configuration as that of the sheet storage unit group of the external printing apparatus can be formed in the printing apparatus, based on the information of the sheets stored in each of the plurality of sheet storage units which the external printing apparatus has, and the sheet storage unit group settings of the external printing apparatus including the paper information received by the reception unit; and a creation unit configured to form, when the determination unit determines that a sheet configuration with the same configuration as that of the sheet storage unit group of the external printing apparatus can be formed in the printing apparatus, sheet storage unit group settings of the printing apparatus and a sheet storage unit group corresponding to a sheet storage unit group formed in the external printing apparatus using arbitrary sheet storage units of the plurality of sheet storage units which the printing apparatus has, based on the information of the sheets stored in each of the plurality of sheet storage units which the external printing apparatus has, and sheet storage unit group settings of the external printing apparatus including the paper information received by the reception unit, wherein configurations of the sheets in the sheet storage units which belong to the sheet storage group of the external printing apparatus are formed to become the same as the sheet storage units of the printing apparatus based on differences between the sheet storage unit group settings of the external printing apparatus and the sheet storage unit group settings of the printing apparatus.

2. The printing apparatus according to claim 1, wherein the determination unit is further configured to determine whether a sheet storage unit group corresponding to a sheet storage unit group which has been previously formed in the external printing apparatus can be formed, using arbitrary sheet storage units of the plurality of sheet storage units which the printing apparatus has, based on the information of sheets stored in each of the plurality of sheet storage units which the external printing apparatus has, and paper information received by the reception unit, wherein the creation unit forms the sheet storage unit group, if the determination unit determines that a sheet storage unit group can be formed.

3. The printing apparatus according to claim 2, further comprising:

an instruction unit configured to allow, if the determination unit determines that a sheet storage unit group cannot be formed, an instruction for forming a sheet storage unit group which is the same as a sheet storage unit group formed previously in the external printing apparatus to be issued, without depending on the information of the sheets stored in each of the plurality of sheet storage units which the external printing apparatus has.

4. The printing apparatus according to claim 1, further comprising:

a second determination unit configured to determine whether a sheet storage unit group corresponding to a sheet storage unit group formed previously in the external printing apparatus can be formed, if the second determination unit determines that a sheet storage unit group cannot be formed, with regard to at least one sheet storage unit group of a plurality of sheet storage unit groups.

5. The printing apparatus according to claim 4, further comprising:

a notification unit configured to notify a user of information concerning a sheet storage unit group which can be formed, if the second determination unit determines that the sheet storage unit group can be formed.

6. The printing apparatus according to claim 5, wherein the creation unit, with regard to a sheet storage unit group selected by the user based on the information notified by the notification unit, forms a sheet storage unit group corresponding to a sheet storage unit group formed previously in the external printing apparatus.

7. The printing apparatus according to claim 1, further comprising:

a selection unit configured to select the external printing apparatus from among a plurality of printing apparatuses connected over a communication line, wherein the reception unit receives the paper information from the external printing apparatus selected by the selection unit.

8. The printing apparatus according to claim 1, wherein the paper information includes information indicating at least a paper size or information indicating a paper type.

9. The printing apparatus according to claim 1, wherein the reception unit receives the paper information and identification information of respective sheet storage units which constitute a sheet storage unit group in the external printing apparatus.

10. A printing apparatus comprising:

a grouping unit configured to group a plurality of sheet storage units that stores sheets to be supplied to a printing unit based on sheet group settings of the printing apparatus; and a reception unit configured to receive, from an external printing apparatus, sheet storage unit group settings of the external printing apparatus including information of sheets stored in each of a plurality of sheet storage units provided in the external printing apparatus, and information with regard to grouping settings of sheet storage units in the external printing apparatus;

a determination unit configured to determine whether a sheet storage unit group with a same configuration as that of the sheet storage unit group of the external printing apparatus can be formed in the printing apparatus, based on the sheet storage unit group settings of the external printing apparatus including the information concerning grouping settings and the information of the sheets, received by the reception unit, wherein the grouping unit performs grouping, when the determination unit determines that a sheet configuration with the same configuration as that of the sheet storage unit group of the external printing apparatus can be formed in the printing apparatus, so as to correspond to grouping settings in the external printing apparatus, based on the sheet storage unit group settings of the external printing apparatus including the information concerning grouping settings and the information of the sheets, received by the reception unit, wherein configurations of the sheets in the sheet storage units which belong to the sheet storage group of the external printing apparatus are formed to become the same as the sheet storage units of the printing apparatus based on sheet storage unit group settings differences between the printing apparatus and the external printing apparatus.

11. A printing apparatus including a plurality of sheet storage units that stores sheets to be supplied to a printing unit, the printing apparatus comprising:

a reception unit configured to receive, from an external printing apparatus in which a sheet storage unit group constituted by arbitrary sheet storage units of a plurality of sheet storage units has been formed, sheet storage unit group settings of the external printing apparatus including paper information that is information of the sheets stored in respective sheet storage units that constitute the sheet storage unit group;

a determination unit configured to determine whether a sheet storage unit group with a same configuration as that of the sheet storage unit group of the external printing apparatus can be formed in the printing apparatus, based on the sheet storage unit group settings of the external printing apparatus including the paper information of the sheets stored in the respective sheet storage units, received by the reception unit; and a control unit configured to control, when the determination unit determines that a sheet configuration with the same configuration as that of the sheet storage unit group of the external printing apparatus cannot be formed in the printing apparatus, not to form in the printing apparatus a sheet storage unit group corresponding to a sheet storage unit group formed previously in the external printing apparatus, if sheets stored in each of a plurality of sheet storage units which the printing apparatus has and sheets stored in each of a plurality of sheet storage units which the external printing apparatus has are different from each other, wherein configurations of the sheets in the sheet storage units which belong to the sheet storage group of the external printing apparatus are formed to become the same as the sheet storage units of the printing apparatus based on differences between the sheet storage unit group settings of the external printing apparatus and the sheet storage unit group settings of the printing apparatus.

12. A control method for a printing apparatus including a plurality of sheet storage units that stores sheets to be supplied to a printing unit, the control method comprising:

receiving, from an external printing apparatus in which a sheet storage unit group constituted by arbitrary sheet storage units of a plurality of sheet storage units has been formed, sheet storage unit group settings of the external printing apparatus including paper information that is information of sheets stored in respective sheet storage units that constitute the sheet storage unit group;

determining whether a sheet storage unit group with a same configuration as that of the sheet storage unit group of the external printing apparatus can be formed in the printing apparatus, based on the information of the sheets stored in each of the plurality of sheet storage units which the external printing apparatus has, and the sheet storage unit group settings of the external printing apparatus including the paper information received by the printing apparatus from the external printing apparatus; and forming sheet storage unit group settings of the printing apparatus and a sheet storage unit group corresponding to the sheet storage unit group formed in the external printing apparatus using arbitrary sheet storage units of the plurality of sheet storage units which the printing apparatus has, when the determining determines that a sheet configuration with the same configuration as that of the sheet storage unit group of the external printing apparatus can be formed in the printing apparatus, based on the information of sheets stored in each of the plurality of sheet storage units which the external printing apparatus has, and sheet storage unit group settings of the external printing apparatus including paper information received by the reception unit, wherein configurations of the sheets in the sheet storage units which belong to the sheet storage group of the external printing apparatus are formed to become the same as the sheet storage units of the printing apparatus based on differences between the sheet storage unit group settings of the external printing apparatus and the sheet storage unit group settings of the printing apparatus.

13. A non-transitory computer-readable storage medium storing computer programs for causing a computer to execute a control method for a printing apparatus including a plurality of sheet storage units that stores sheets to be supplied to a printing unit, the control method comprising:

receiving, from an external printing apparatus in which a sheet storage unit group constituted by arbitrary sheet storage units of a plurality of sheet storage units has been formed, sheet storage unit group settings of the external printing apparatus including paper information that is information of sheets stored in respective sheet storage units that constitute the sheet storage unit group;

determining whether a sheet storage unit group with a same configuration as that of the sheet storage unit group of the external printing apparatus can be formed in the printing apparatus, based on the on the information of sheets stored in each of the plurality of sheet storage units which the external printing apparatus has, and sheet storage unit group settings of the external printing apparatus including paper information received by the reception unit; and forming sheet storage unit group settings of the printing apparatus and a sheet storage unit group corresponding to the sheet storage unit group formed in the external printing apparatus using arbitrary sheet storage units of the plurality of sheet storage units which the printing apparatus has, when the determining determines that a sheet configuration with the same configuration as that of the sheet storage unit group of the external printing apparatus can be formed in the printing apparatus, based on the information of sheets stored in each of the plurality of sheet storage units which the external printing apparatus has, and sheet storage unit group settings of the external printing apparatus including paper information received by the reception unit, wherein configurations of the sheets in the sheet storage units which belong to the sheet storage group of the external printing apparatus are formed to become the same as the sheet storage units of the printing apparatus based on differences between the sheet storage unit group settings of the external printing apparatus and the sheet storage unit group settings of the printing apparatus.

* * * * *